United States Patent [19]

Tada et al.

[11] Patent Number: 4,975,742

[45] Date of Patent: Dec. 4, 1990

[54] TONER DENSITY CONTROL DEVICE

[75] Inventors: Tomio Tada; Junichi Takamatsu, both of Osaka, Japan

[73] Assignee: Mita Industrial Co., Ltd., Osaka, Japan

[21] Appl. No.: 272,808

[22] Filed: Nov. 18, 1988

[30] Foreign Application Priority Data

Nov. 26, 1987 [JP] Japan ..... 62-298022

[51] Int. Cl.[5] ..... G03G 15/08

[52] U.S. Cl. ..... 355/208; 355/246

[58] Field of Search ..... 355/203–209, 355/245, 246, 326, 327; 118/688–691

[56] References Cited

U.S. PATENT DOCUMENTS 4,622,916 11/1986 Tanaka et al. ..... 355/245 X

FOREIGN PATENT DOCUMENTS 59-164572 9/1984 Japan ..... 355/208

59-202474 11/1984 Japan ..... 355/246

*Primary Examiner*—Joan H. Pendegrass

*Attorney, Agent, or Firm*—Beveridge, DeGrandi & Weilacher

[57] ABSTRACT

The toner density control device of the invention is adapted to an image forming apparatus in which a plurality of processes for image formation are executed, and includes a toner sensor for detecting toner density in a developing section of the image forming apparatus, toner supplying means for supplying toner to the developing section according to output of the toner sensor, and cancelling means for temporarily cancelling function of the toner supplying means or output of the toner sensor in response to switching of operations in the process for image formation. Even if a meachanical vibration is generated during switching of operations in the process for image formation, the function of the toner supplying means or the output of the toner sensor is temporarily cancelled, so that an erroneous detection of toner density or inappropiate toner density control based on the aforesaid errorneous detection can be avoided. Accordingly, it is possible to prevent such a drawback that the density of a formed image becomes too dark or too weak in places due to mechanical vibration in the process of the image formation.

6 Claims, 8 Drawing Sheets

MEMORY AREA FOR TONER DENSITY CONTROL
CARRY FLAG 1 0 0 0 0 0 0 0
0

0 1 1 1 1 1 1 1
1

1 1 0 0 1 1 1 0
1

TONER DENSITY CONTROL DEVICE

BACKGROUND OF THE INVENTION

The present invention relates to a toner density control device, being adapted to an image forming apparatus such as a copier, a printer, a facsimile or the like wherein development is performed in such a manner that an electrostatic latent image is formed, and toner is applied thereto.

An explanation will now be made taking a copier having a movable original platen for an example of the image forming apparatus.

A copier of this type is provided with a toner sensor for detecting the density of toner stored in the developing section.

Generally, in the process of image formation, mechanical vibration occurs to the whole body of a copier when the original platen changes its movement from the return direction to the exposing direction and, conversely, from the exposing direction to the return direction after the completion of exposure. This vibration disturbs the flow of toner in the developing section, causing erroneous detection of toner density by the toner sensor and irregularity in the waveform of the output signal therefrom (this irregularity is generally called as a whisker).

FIG. 7 shows an example of the influence of the above-described vibration upon the output of the toner sensor. FIG. 7 is a graph showing a part of the output waveform of the toner sensor in the case a plurality of copying operations for a single document are continuously carried out, where coordinates are time on the abscissa and output voltage on the ordinate. The irregularity of the waveform indicated by part i of this graph is caused by the vibration generated when the original platen commences its return movement for starting copying operation, and the irregularity of the waveform indicated by part ii is caused by the vibration generated when the original platen stops its return movement, and the irregularity of the waveform indicated by part iii is caused by the vibration generated at a moment when the original platen begins to move for exposure.

As described above, mechanical vibration in a copier often affects the output of a toner sensor, that is, mechanical vibration brings about erroneous detection of toner density, resulting in an inappropriate toner supply in compliance with the output of the toner sensor based on the above erroneous detection. This considerably deteriorates the accuracy of the toner density control.

Such a drawback occurs not only in the aforesaid copier having a movable original platen but also in a copier having a movable exposure lamp and movable mirror, a facsimile and the like.

SUMMARY OF THE INVENTION

It is an object of the present invention to provide a toner density control device capable of avoiding erroneous detection due to the abovedescribed mechanical vibration and accomplishing highly precise toner density control.

The toner density control device of the present invention is adapted to an image forming apparatus wherein a plurality of processes for image formation are executed, and comprises a toner sensor for detecting the toner density in the developing section of the image forming apparatus, toner supplying means for supplying toner to the developing section according to the output of the toner sensor, and cancelling means for temporarily cancelling the output of the toner sensor or the function of the toner supplying means in response to switching of operations in the process of image formation.

The above "operations" include all the operations that cause mechanical vibration to the image forming apparatus by switching thereof.

Mechanical vibration in an image forming apparatus is caused by switching of operations for image formation. Therefore, the cancelling means temporarily cancels the output of the toner sensor or the function of the toner supplying means at the time when operations are switched thereby to prevent inappropriate toner density control based on the erroneous detection of toner density. Accordingly, it is possible to prevent such a drawback that the density of a formed image becomes too dark or too weak in places due to mechanical vibration in the process of image formation.

The advantages of the invention will now be clarified by the following description taken in conjunction with the accompanying drawings, in which:

DETAILED DESCRIPTION OF THE EMBODIMENTS

In the following description of the embodiments of the invention, a copier having a light, small-sized and movable original platen is explained. The present invention, however, is not limited to a copier of the above type but can be broadly adapted to all types of image forming apparatuses in which mechanical vibration is generated following switching of operations (such as a paper feed starting operation by a paper feeding roller, and an exposure lamp moving operation in a copier having a movable exposure lamp) in the process of image formation.

Figure 2:
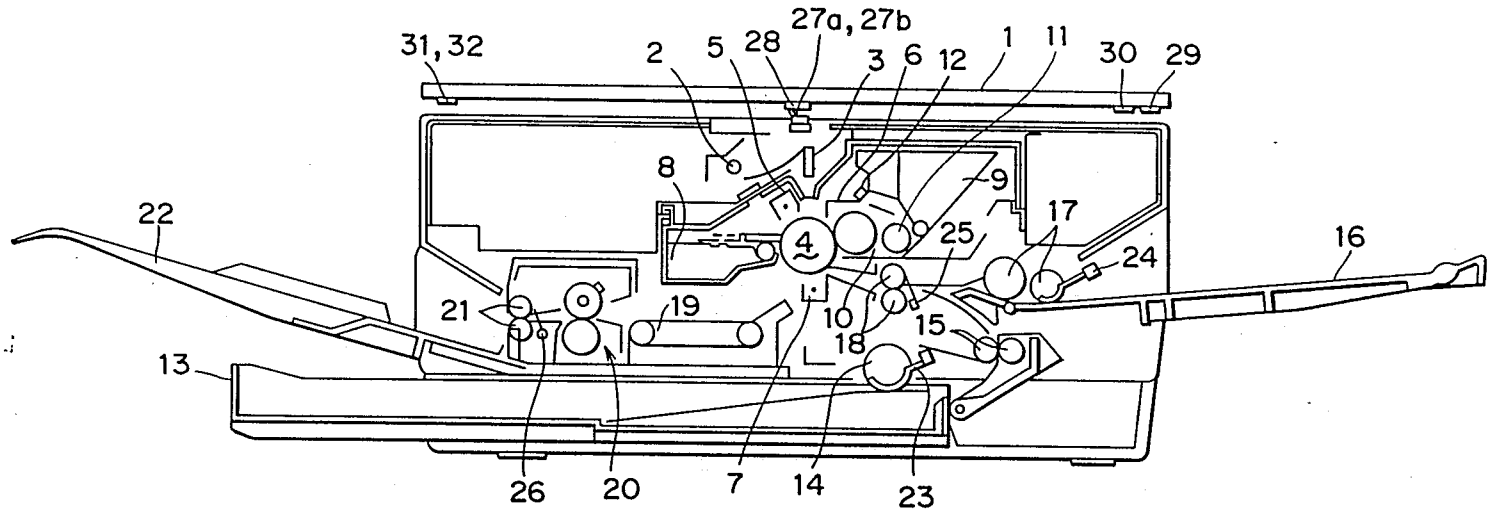
FIG. 2 is an illustration showing the whole arrangement of a copier having a movable original platen according to the embodiment.

FIG. 2 is a schematic sectional view showing a whole arrangement of a copier to which an embodiment of the present invention is adapted. Disposed at the upper part of the body of the copier is a movable original platen 1 onto which an original is placed. Facing to the original platen 1, an optical system comprising an exposure lamp 2 for exposing an original, and a focusing lens 3 for focusing exposed reflected light, is disposed inside the body.

There are provided a photosensitive drum 4 for forming an electrostatic latent image with the light focused by the focusing lens 3, and corona discharger 5, developing device 6, transferring corona discharger 7 and cleaner 8 around the photosensitive drum 4 in this order. The corona discharger 5 is provided for uniformaly charging the photosensitive layer in the surface of the photosensitive drum 4, and the light from the focusing lens 3 is irradiated to the uniformaly charged photosensitive layer, thereby forming an electrostatic latent image corresponding to the irradiated light. The developing device 6 for developing the electrostatic latent image by fixing toner on the surface of the photosensitive drum 4, is provided with a toner supplying roller 11 for supplying the toner stored in a hopper 9 into a developer tank 10 and a toner sensor 12 for detecting the density of the toner in the developer tank 10. The transferring corona discharger 7 transfers a toner image formed on the surface of the photosensitive drum 4 onto a copy sheet and the cleaner 8 collects the residual toner on the surface of the photosensitive drum 4.

The copier is further provided with a copy paper delivery mechanism. This mechanism includes a paper feeding roller 14 for taking a copy sheet from a cassette 13 in which copy sheets are stored, a pair of delivery rollers 15 for delivering a taken out copy sheet, manual paper feeding rollers 17 for taking in a copy sheet which has been inserted from a manual paper feeding tray 16, a pair of resist rollers 18 for determining the timing of paper feeding to the photosensitive drum 4, a delivery belt 19 for delivering a copy sheet with a toner image transferred thereon, a fusing device 20 for fusing a transferred toner image, a pair of discharging rollers 21 for discharging a copy sheet with a toner image fixed thereon, onto a copy receiving tray 22.

The copy paper delivery mechanism is provided with various switches for determining the timing of delivery of copy sheets. In particular, there are provided a paper detection switch 23 for detecting the presence/absence of a copy sheet in the cassette 13, stack switch 24 for manual paper feeding, resist switch 25 for determining the presence of a copy sheet to be fed to the photosensitive drum 4, discharging switch 26 for detecting the discharge of a copy sheet, and the like.

Figure 3:
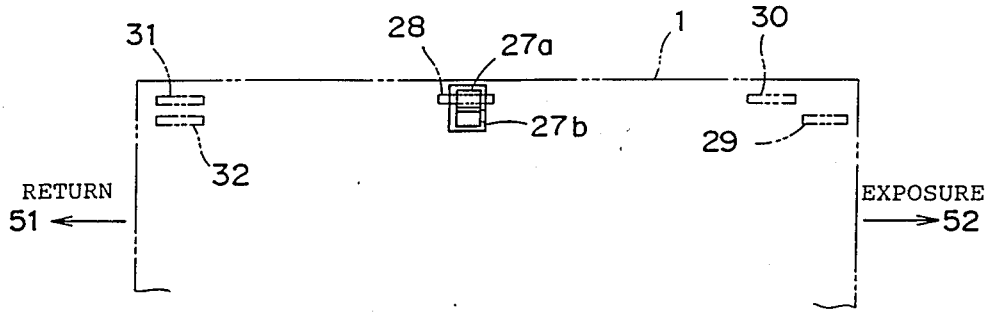
FIG. 3 is a schematic illustration showing the positional relationship between the pair of positional detection switches and projections.

Next, the positional detection mechanism during the movement of the original platen 1 will be explained with reference to FIGS. 2 and 3.

As shown in FIG. 2, a pair of positional detection switches **27*a* and 27*b* for detecting the position of the original platen 1 is provided on the upper surface of the body of the copier and five projections 28 through 32 are respectively provided at the predetermined positions on the bottom surface of the original platen 1. The positional relationship between the positional detection switches 27*a* and 27*b*, and the projections 28 through 32 is shown in the plane view of FIG. 3. More specificaly, the positional detection mechanism is provided with the projection 28 for pressing the positional detection switch 27*a* when the original platen 1 is at the home position, the projection 29 for pressing the positional detection switch 27*b* when the original platen 1 moves in the return direction 51 and reaches to the exposure starting position, the projection 30 for pressing the positional detection switch 27*a* in order to detect that the leading edge of an original comes to the exposure starting position just after the original platen 1 starting to move in the exposing direction 52, and the projections 31 and 32 for pressing the positional detection switches 27*a* and 27*b* when the original platen 1 completes its movement in the exposing direction 52**.

Figure 4:
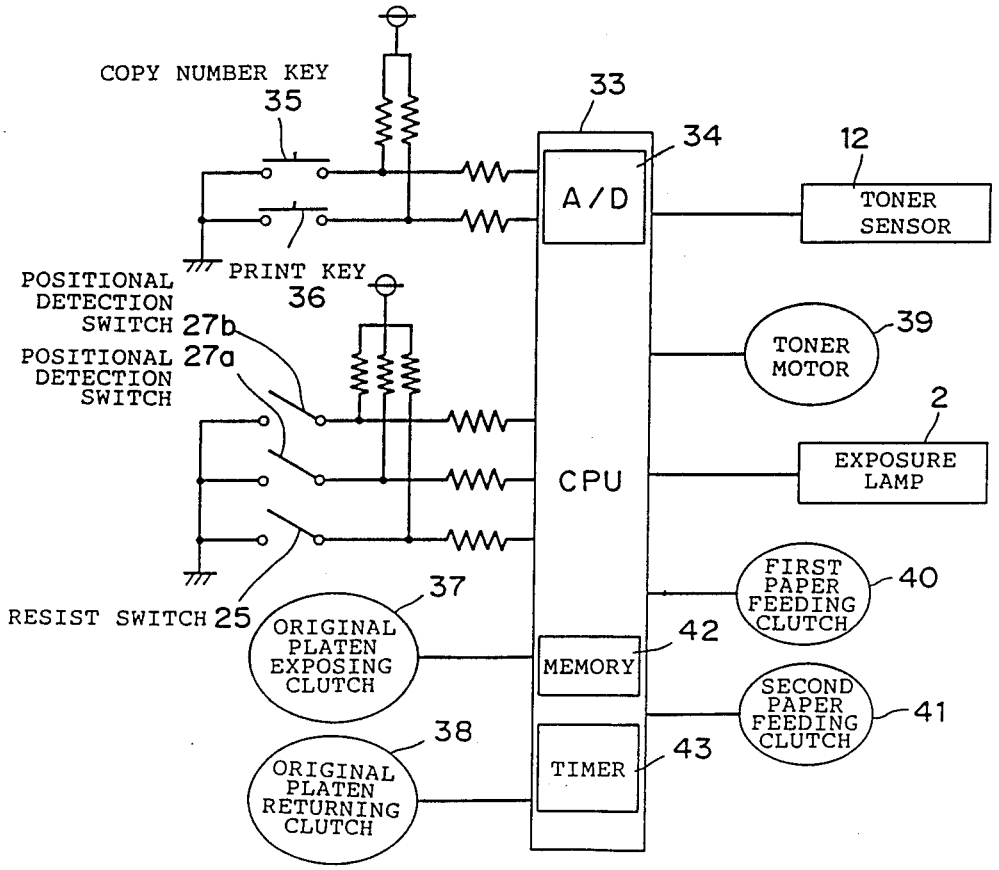
FIG. 4 is a block diagram showing the arrangement of the control section of the copier according to the embodiment.

FIG. 4 is a schematic block diagram of the control section of the copier and the peripheral equipments.

An analog signal is entered in the CPU 33 from the toner sensor 12 and converted to a digital signal by an analog/digital (A/D) converter 34. On/off signals from the resist switch 25 provided at the copy paper delivery mechanism, and from the positional detection switches **27*a* and 27*b* for detecting the position of the original platen i are entered in the CPU 33. Signals from a copy number key 35 and print key 36 both provided at an operation panel (not shown in the figure) are also entered in the CPU 33**.

The CPU 33 carries out control operation in response to various input signals such as the above and activates an original platen exposing clutch 37 and original platen returning clutch 38 thereby making the original platen 1 move in the exposing direction 52 and in the return direction 51. The CPU 33 also activates a toner motor 39 and rotates the toner supplying roller 11 shown in FIG. 2 thereby to supply the toner stored in the hopper 9 to the developer tank 10. Further, the CPU 33 controls turning on/off of the exposure lamp 2 and controls a first paper feeding clutch 40 and a second paper feeding clutch 41 thereby to control the paper delivery executed by the copy paper delivery mechanism (see FIG. 2).

The CPU 33 is provided with a memory 42 for storing programs and data required for the above control operations and a timer 43 necessary for timing.

In the block diagram of FIG. 4, only the switches and members to be controlled that are necessary for the description of the embodiment are shown, and other members that are not particularly necessary for explaining the embodiment are omitted.

Figure 5A:
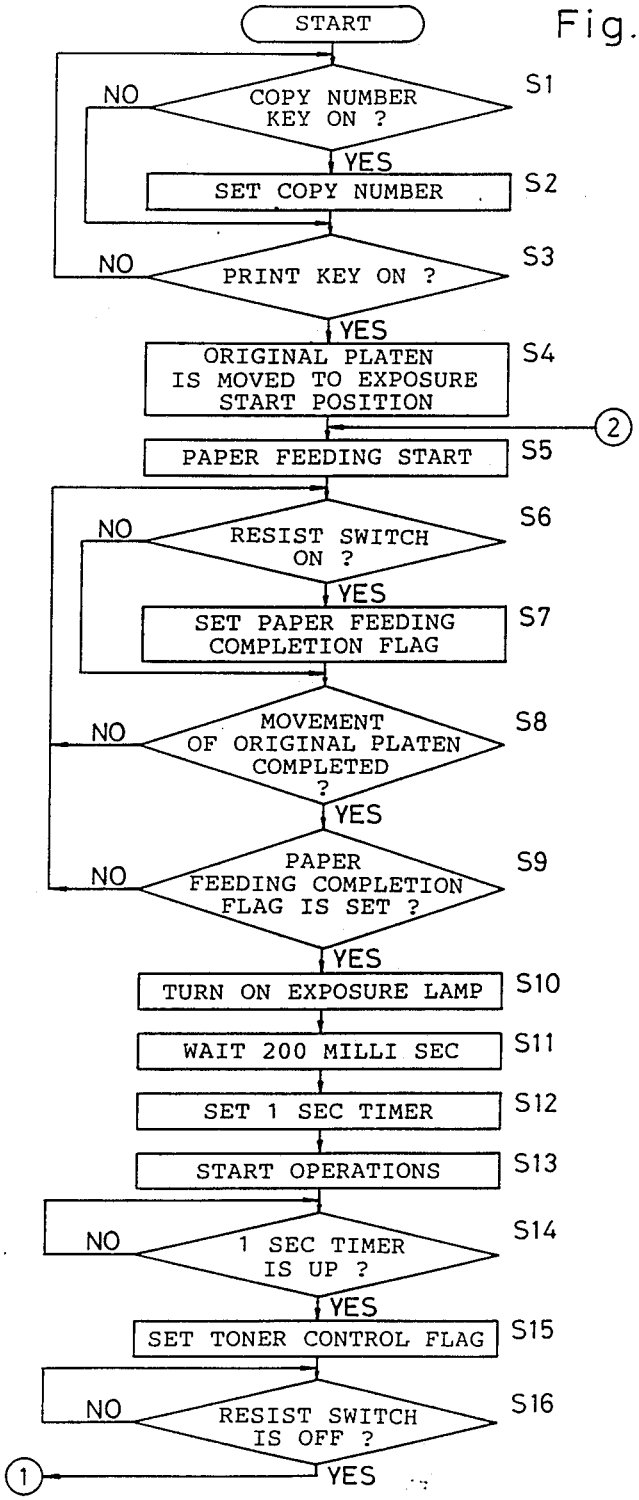
FIGS. 5A and 5B are flow charts showing the whole operations of the copier according to the embodiment.
Figure 5B:
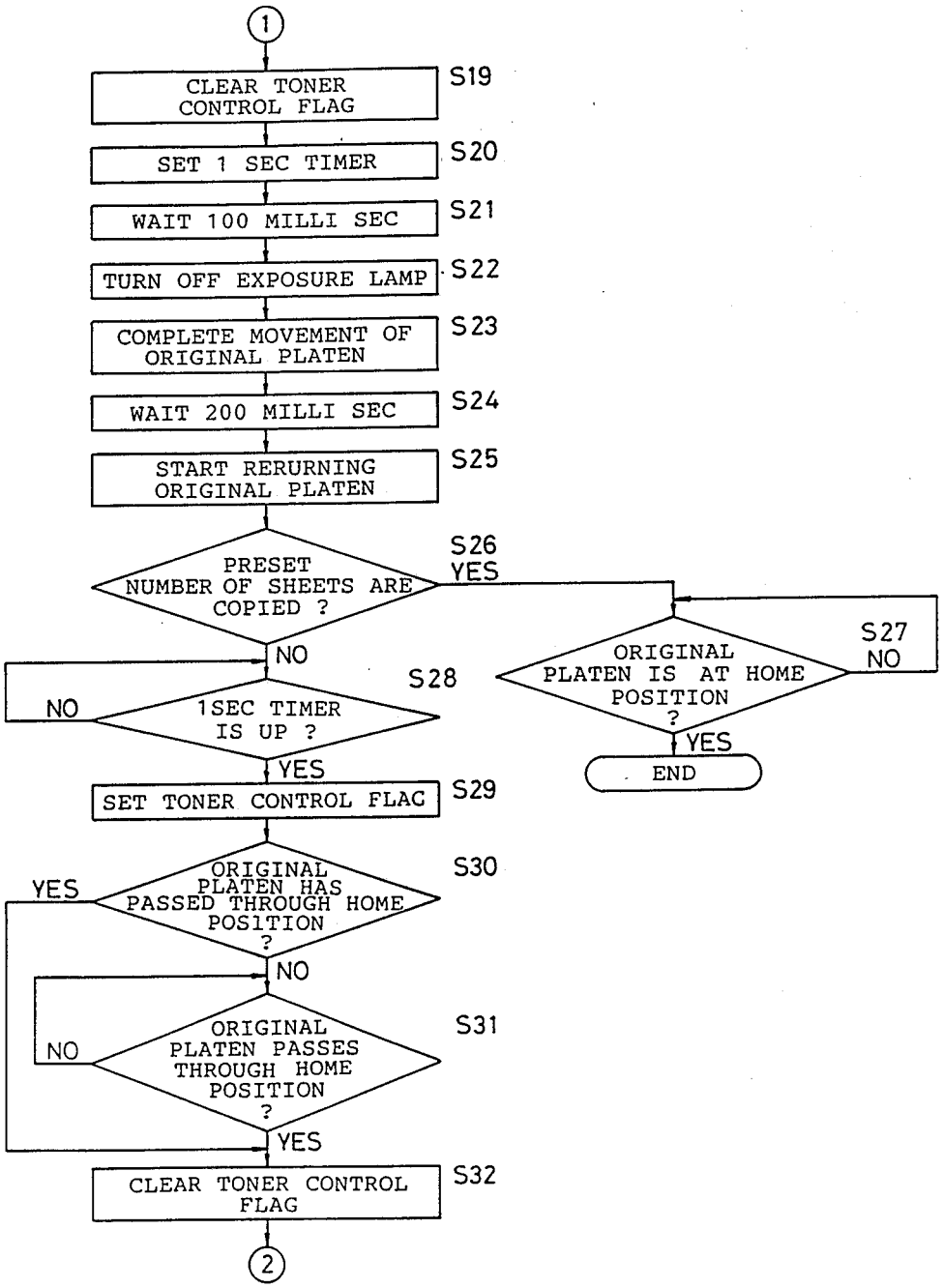

FIGS. 5A and 5B are flow charts showing the control operation of the CPU 33 illustrated in FIG. 4. With reference to FIGS. 2 through 4, and following the flows of FIGS. 5A and 5B, the changeover of the movement of the original platen 1 according to the copy sheet size will be described.

The CPU 33 starts the control operation with setting the number of copying operations in the memory 42 in accordance with an input signal from the copy number key 35 and then determines whether or not the print key 36 was depressed (steps S1, S2 and S3). If the CPU 33 determines that the print key 36 was depressed, the original platen returning clutch 38 is activated to move the original platen to the exposure starting position and the first paper feeding clutch 40 is activated driving the paper feeding roller 14 and delivery roller pair 15 thereby to start paper feeding to the the resist roller 18 (steps S4 and S5).

If the print key 36 was depressed without the copy number key 35 being depressed in steps S1 and S3, the CPU 33 executes copying operations for the number of sheets (for example, one sheet) which has been preset in the memory 42.

Then, the CPU 33 determines whether or not the resist switch 25 was depressed and the original platen 1 has completed its movement to the exposure starting position (steps S6, S8). The completion of the movement of the original platen 1 toward the exposure starting position is determined by a signal from the positional detection switch **27*b*, since the positional detection switch 27b is turned on by the projection 29 upon the completion. In the meanwhile, when a copy sheet taken from the cassette 13 shown in FIG. 2 is delivered and the leading edge thereof reaches to the resist roller 18, the resist switch 25 disposed just ahead of the resist roller 18 is turned on by the leading edge of the copy sheet. By turning on the resist switch 25, the CPU 33 sets a paper feeding completion flag that is provided in the memory 42** (step S7).

When the movement of the original platen 1 toward the exposure starting position is completed with turning on of the positional detection switch 27b and paper feeding to the resist roller 18 is completed with setting of the paper feeding completion flag (steps S8, S9), the CPU 33 turns on the exposure lamp 2 and then waits for 200 msec. until the luminosity of the exposure lamp 2 is stabilized. While the timer 43 starts to count "1 sec.", exposing operation and a series of operations concerning therewith are started (steps S10, S11, S12 and S13). The aforesaid series of operations mean operations for activating the original platen exposing clutch 37 thereby to move the original platen 1 in the exposing direction 52, and activating the second paper feeding clutch 41 thereby to guide a copy sheet to the photosensitive drum 4 by means of the resist roller 18.

In the following step S14, the CPU 33 waits until the timer 43 counts 1 sec. and sets a toner control flag in the memory 42 upon completion of the count (step S15). The count of 1 sec. by the timer 43 and setting of a toner control flag following the completion of the count are essential to the toner density control of this embodiment, and therefore will be described in more detail in the description taken in conjunction with FIG. 1.

Next, the CPU 33 waits until the resist switch 25 is turned off (step S16). As described above, the resist switch 25 is disposed just ahead of the resist roller 18, and it is turned on when the leading edge of a copy sheet reaches to the resist roller 18 and turned off when the resist roller 18 discharges the trailing edge of the copy sheet which has been delivered by the resist roller 18 (see FIG. 2). Accordingly, the CPU 33 determines by the turning off of the resist roller 26 that the second feeding of a copy sheet has been completed.

The CPU 33 clears the toner control flag in the memory 42 in response to an off-signal from the resist switch 26 (step S19), starts counting 1 sec. again by the timer 43 (step S20), turns off the exposure lamp 2 after a 100 msec. delay period (steps S21, S22), completes the exposure by completing the movement of the original platen 1 in the exposing direction 52 (step S23), and starts to return the original platen 1 after a 200 msec. delay period (step S25). The 100 msec. delay period in step S21 is executed for assuring the complete exposure from the leading edge to the trailing edge of the original so as to form a perfect image, and the 200 msec. delay period in step S24 for waiting for the original platen exposing clutch 37 to be completely de-energized so as to cut off the transmission of driving power.

In step S26, the CPU 33 determines whether or not the number of sheets that have been copied reaches to the preset number of copied sheets entered in the memory 42, and if it does, the CPU 33 proceeds to step S27 in which the positional detection Switch 27a is turned on, when the original platen 1 reaches to the home position, and then the original platen is halted at the home position by disconnecting the original platen returning clutch 38 thereby completing the control operation.

On the other hand, if the number of sheets that have been copied does not reach to the preset number of copied sheets, the CPU 33 waits until the timer 43 counts 1 sec. (step S28), sets the toner control flag in the memory 42 for the next series of copying operations (step S29), and clears the toner control flag again based on the passing of the original platen 1 through the home position during its movement in the returning direction 51 (steps S30, S31, S32). Then, the foregoing steps from step S5 onward are repeated.

The foregoing is the outline of the copying operation with use of the copier.

Figure 1A:
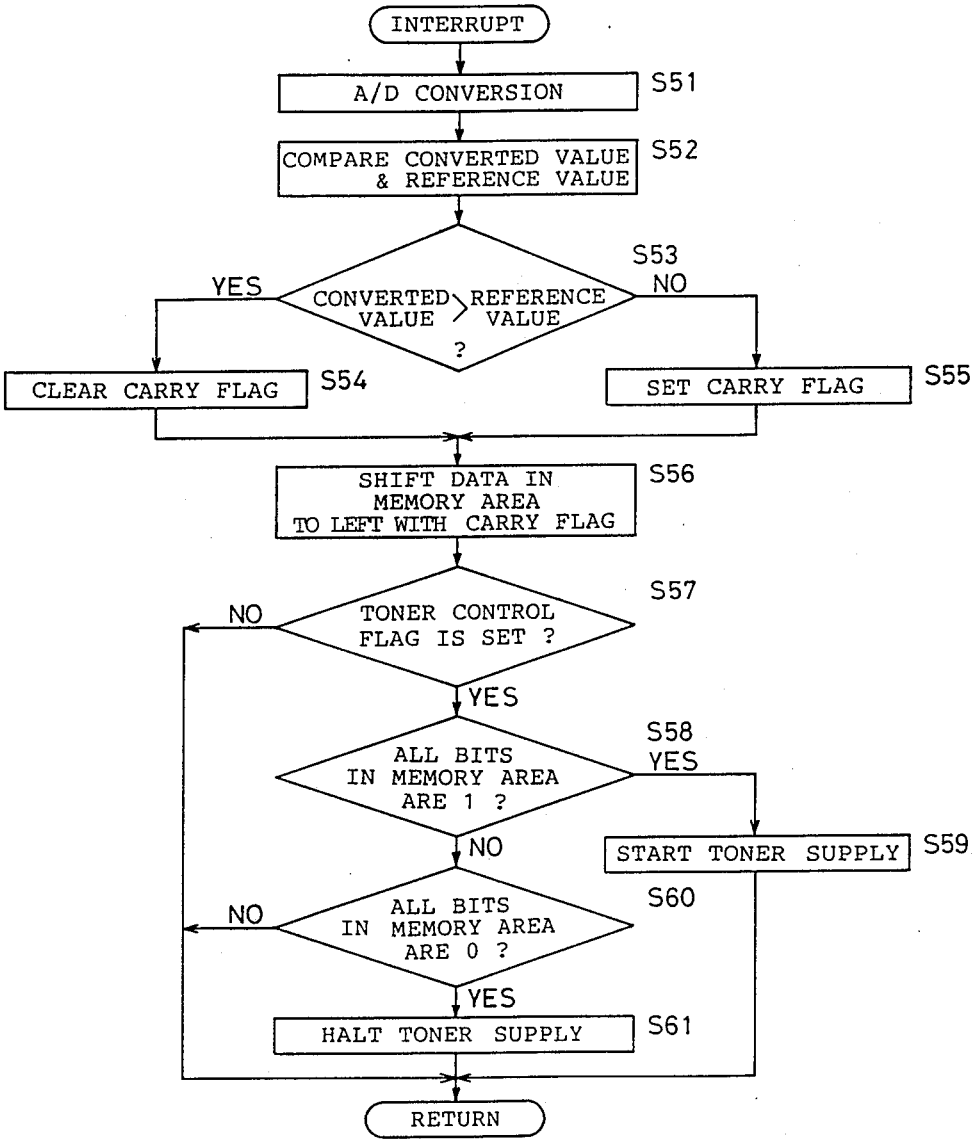
FIG. 1A is a flow chart showing toner density control operations according to an embodiment of the present invention.
Figure 1B:
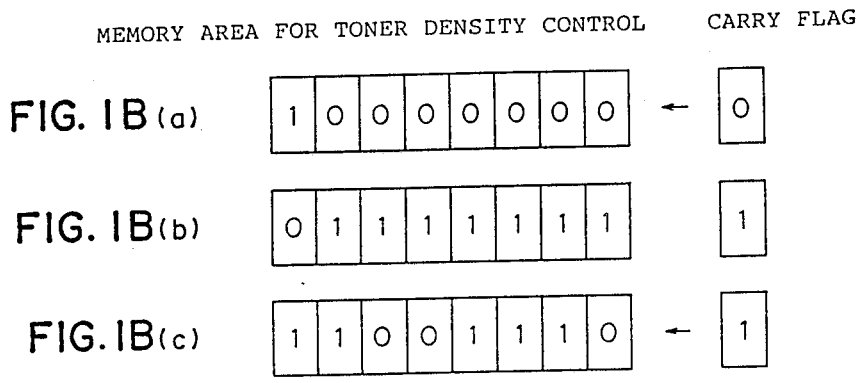
FIG. 1B(*a*)–1B(*c*) is a diagram of a memory area for toner density control.

Referring now to FIGS. 1A and 1B, the toner density control operation with use of the copier will be explained.

FIG. 1A is a flow chart showing the outline of the toner density control by the CPU 33 executed by interrupting operation, and FIG. 1B is a diagram showing the memory area used for the toner density control.

With reference to FIGS. 1A, 1B and 4, the CPU 33 executes interrupting operation, for example, at 2 msec. intervals, thereby converting an analog signal from the toner sensor 12 into an digital signal by the A/D converter 34 (step S51) and comparing the converted value with a reference value stored in the memory 42 (step S52). The CPU 33 clears a carry flag so as to be zero when the converted value is greater than the reference value and sets the carry flag value to 1 when the converted value is equal to the reference value or less (steps S53, S54 and S55).

In this case, the carry flag is provided in the memory 42 and represents 1 bit data of "0" or "1".

The CPU 33 proceeds to step S56. A memory area for toner density control will be now explained prior to the explanation for step S56. The memory area for toner density control is positioned in the memory 42 and consists of regions for storing 8-bit data for example, as shown in FIG. 1B.

In step S56, the CPU 33 shifts all the data in the memory area for toner density control by one position left at 2 msec. intervals and at the same time, the content of the carry flag is entered to the right end region of the memory area for toner density control. Accordingly, if the aforementioned operation is executed in the case of FIG. 1B(*a*), 8 bits in the memory area for toner density control become all "0". Further, 8 bits become all "1" in the case of (b), and become "10011101" in the case of (c) where "0" and "1" exist in an array together.

In step S57, the CPU 33 determines whether the toner control flag in the memory 42 is in a set-state or not and if the toner control flag has been cleared, the program proceeds to "Return". As described in FIGS. 5A and 5B, switching of the toner control flag to the set-state or to the cleared-state is executed in accordance with the copying processes of the copier.

More specifically, the toner control flag is in the cleared-state during the movement of the original platen 1 from the home position to the exposure starting position and for 1 sec. after the starting of exposure. The toner control flag is also in the cleared-state for 1 sec. from just before the completion of the exposure (more specifically, 1 sec. is counted from 100 msec. before the completion of exposure), that is, the toner control flag is in the cleared-state during the movement of the original platen 1 is switched from the exposing direction 52 to the returning direction 51. The toner control flag is in the set-state at the time other than the above. That is, mechanical vibration is generated in the copier of this embodiment when the moving direction of the original platen 1 is changed, so that the toner control flag is designed to be in the cleared-state during the generation of the aforesaid vibration.

As described above, the period counted by the timer 43 is set to "1 sec." in this embodiment, but it it not limited to "1 sec." but can be any length of time on condition that it is enough to pause for the toner density control operation. More specifically, this time period is determined depending on the time in which the mechanical vibration caused by the switching of the moving direction of the original platen 1 continues.

If the toner control flag is set, the CPU 33 proceed to step S58.

In step S58, the CPU 33 determines Whether or not 8 bits in the memory area for toner density control are all "1" and if they are, the CPU 33 activates the toner motor 39 to rotate the toner supplying roller 11, thereby feeding the toner stored in the hopper 9 into the developer tank 10 (see step S59 in FIG. 2). On the other hand, if 8 bits in memory area for toner density control are all "0", the CPU 33 halts the toner motor 39 thereby stopping a supply of toner to the developer tank 10 (steps S60, S61).

As described above, the CPU 33 is caused to return to the main program if the toner control flag is not set in step S57 in FIG. 1A. In other words, the determination of feeding toner or halting a supply of toner is temporarily cancelled in response to the changeover of the movement of the original platen 1. Accordingly, in case the toner sensor erroneously detects toner density due to mechanical vibration or the like, an inappropriate toner density control based on the aforesaid erroneous detection can be avoided.

In the above embodiment, the memory area for toner density control constitutes 8 bits and when all the bits become "1", a supply of toner is started and when all the bits become "0", a supply of toner is stopped. Therefore, when a signal differing from the actual toner density is entered due to an instantaneous disturbance in the output from the toner sensor that is caused by accidental mechanical vibration during the movement of the original platen 1 with the toner control flag being set, erroneous toner density control can be avoided.

The memory area for toner density control according to the above embodiment constitutes 8 bits, but it may constitute, for example, 4 bits.

In the above embodiment, the converted output from the toner sensor 12 is compared with a reference value, a carry flag is set or cleared, all the data stored in the memory area for toner density control are one position shifted to left, the data of the carry flag is entered in the right end region of the memory area and thereafter, it is determined whether or not the toner control flag is set (steps S51 to S57). Accordingly, even when the toner control flag is cleared, the data stored in the memory area for toner density control are varied based on the output from the toner sensor 12. Therefore, if the toner sensor 12 performs an erroneous detection due to mechanical vibration or the like, the data stored in the memory area for toner density control will be renewed by the erroneous toner density data.

Figure 6:
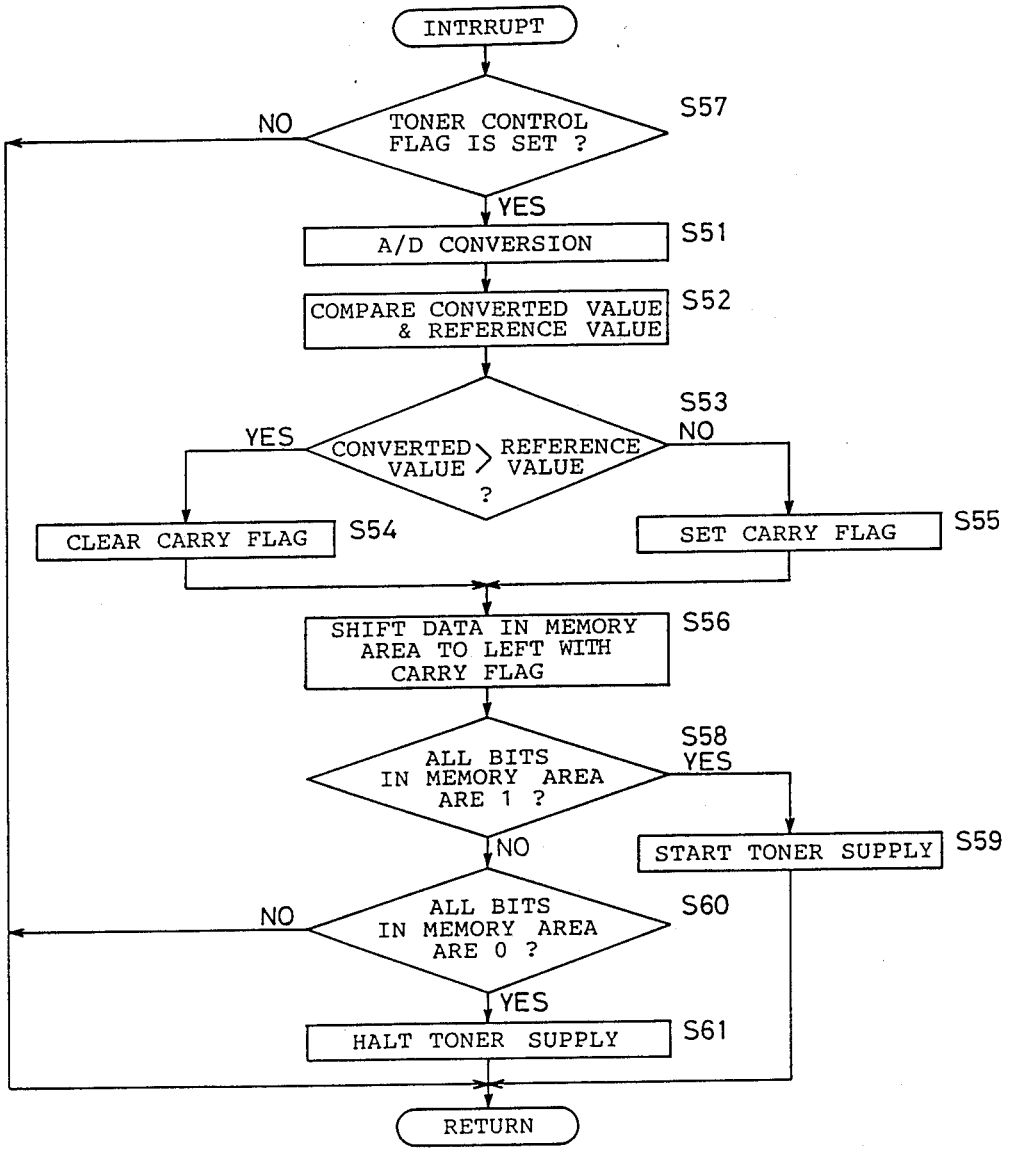
FIG. 6 is a flow chart showing the toner density control operation according to another embodiment of the present invention.
Figure 7:
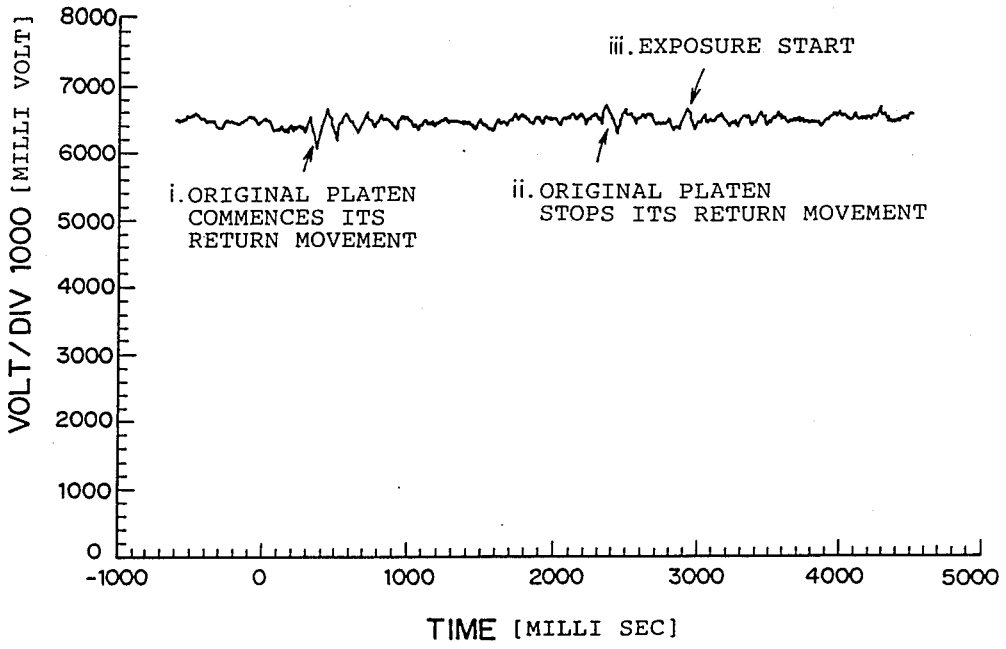
FIG. 7 is a waveform chart showing the relationship between an output waveform of a toner sensor and mechanical vibration in a copier having a movable original platen.

Such an inconvenience can be prevented by the determination as to whether the toner control flag is set or cleared just after the start of interrupting operation. More specifically, it can be prevented by excuting the proceeding of step S57 just after the start of interrupting operation and immediately returning to the main program if the toner control flag is reset, as shown in FIG. 6. With the aforementioned operation, the output from the toner sensor can be cancelled. Accordingly, in case the toner sensor erroneously detects toner density due to mechanical vibration or the like, an inappropriate toner density control based on the output of the erroneous detection can be prevented thereby considerably improving the accuracy of the toner density control operation.

The present invention is not limited to the the specific embodiments, and various changes and modifications are possible without departing from the scope of the invention.

What is claimed is:

1. A toner density control device adapted to an image forming apparatus wherein a plurality of processes for image formation are executed and an original image is developed by forming an electrostatic latent image to which toner is applied, said apparatus including a platen for supporting an original document and an exposure lamp for illuminating an original document which is supported on the platen, means for providing relative movement between said platen and said exposure lamp to scan the document, said means for providing relative movement being operable to change the direction of relative movement, said toner density control device comprising;

a toner sensor for detecting toner density in a developing section of the image forming apparatus, toner supplying means for supplying toner to the developing section according to output of the toner sensor, and cancelling means including means for temporarily disabling the toner supplying means during the time of said change in direction between the platen and the exposure lamp.

2. A toner density control device according to claim 1, wherein the outputs of the toner sensor are accumulated and the toner supplying means is operated in accordance with the accumulated result.

3. A toner density control device according to claim 1, wherein the function of the toner supplying means is cancelled for a predetermined period after the switching of operations in the image forming process.

4. A toner density control device adapted to an image forming apparatus wherein a plurality of processes for image formation are executed and an original image is developed by forming an electrostatic latent image to which toner is applied, said toner density control device comprising;

a toner sensor for detecting toner density in a developing section of the image forming apparatus, a controller means for receiving data from said toner sensor, toner supplying means for supplying toner to the developing section according to output of the toner sensor, and cancelling means including the following:

cancelling means for temporarily interrupting input of data from the toner sensor to the controller means in response to a vibration-producing switching of operations in the processes for image formation.

5. A toner density control device according to claim 4, wherein the outputs of the toner sensor are accumulated and the toner supplying means is operated in accordance with the accumulated result.

6. A toner density control device according to claim 4, wherein the output of the toner sensor is cancelled for a predetermined period after the switching of operations in the image forming process.

* * * * *